United States Patent [19]

Scott

[11] 4,170,075

[45] Oct. 9, 1979

[54] NOZZLE FOR WEB PROCESSING APPARATUS

[75] Inventor: John F. Scott, Oreland, Pa.

[73] Assignee: Proctor & Schwartz, Inc., Philadelphia, Pa.

[21] Appl. No.: 883,296

[22] Filed: Mar. 3, 1978

[51] Int. Cl.[2] ..... F26B 13/00

[52] U.S. Cl. ..... 34/160; 34/241; 239/568

[58] Field of Search ..... 34/241, 160, 158, 242, 34/210, 155, 156; 239/568

[56] References Cited

U.S. PATENT DOCUMENTS

| | | | |
|---|---|---|---|
| 3,041,739 | 7/1962 | Meier-Windhorst | 34/156 |
| 3,134,654 | 5/1964 | Russell | 34/160 |
| 3,319,354 | 5/1967 | Hering, Jr. et al. | 34/160 X |
| 3,429,057 | 2/1969 | Thygeson, Sr. | 34/160 |
| 4,060,914 | 12/1977 | Hoffman | 34/160 X |

*Primary Examiner*—Edward G. Favors
*Attorney, Agent, or Firm*—Richard H. Thomas

[57] ABSTRACT

The present invention relates to gas treating apparatus for treating web-like or granular material conveyed through the apparatus, and more particularly to a novel nozzle arrangement for such apparatus which insures that a uniform, unbroken stream of treating medium impinges against the web-like or granular material. The present invention is particularly applicable to the transverse orientation of polymer film, the drying of particulate material, the drying or heat setting of films or fabrics, and other such applications where precise control of processing conditions is required.

2 Claims, 5 Drawing Figures

NOZZLE FOR WEB PROCESSING APPARATUS

The present invention relates to gas treating apparatus for impinging a treating medium against web-like or granular materals conveyed through such apparatus. The present invention will be particularly described with reference to heating apparatus having means for supplying a gaseous heating medium and impinging the same against web-like or granular materials, although it will be appreciated by those skilled in the art that the present invention has other applications, for instance the heat setting, curing, annealing and tempering of materials where precise control of processing conditions is required. Examples of such applications are the transverse orientation of polymer film, the drying or heat setting of fabrics, and the curing of resins and adhesives on fabrics.

BACKGROUND OF THE INVENTION

In conventional recirculating air heating apparatus and other such process apparatus, it is common to use transverse or cross-web air jets to impinge the air against a surface or material being treated. Heat transfer rates attainable by impingement of air jets is greater than normally associated with gas phase heat transfer. This leads to compact, low cost equipment and more precise control of processing conditions.

Practical application of air jets will normally employ an array of the transverse or cross-web jets. Generally speaking, maximum heat transfer rates are attained with a large number of smaller jets. However, minimum jet dimensions are usually limited by practical considerations such as the increased tendency of smaller nozzles to plug. In this regard, lint or fines accumulation, particularly at places in the air flow system having directional vanes or sharp breaks, can result in uneven or broken air flow at the nozzles. Although filters may be used extensively in recirculating type dryers, the filters are incapable of removing very fine lint particles or fines which tend to build up and cause accumulations at the areas of greatest change in the direction of flow in the pressurized recirculation system.

Also of critical importance, particularly for thermally sensitive operations where uniformity and control of localized rates is vital to optimum performance, is the nozzle arrangement and design. Conventionally it has been the practice to provide deflectors or directional vanes interiorly of the nozzle structure to direct the air flow so that it strikes the web being heat treated substantially perpendicular thereto. This is desirable and necessary for proper heat treating or material processing, eliminating unbalanced, transverse impact or sensitive surfaces. However, the use of directional vanes can result in lint or fines accumulation in the nozzles and again uneven, transverse or cross-web air flow. This in turn can cause stripping of the web and/or uneven heat treating or processing in addition to making the apparatus less efficient overall.

In prior U.S. Pat. No. 3,429,057, assigned to assignee of the present application, there was discussed a novel nozzle arrangement for dryers and other air treating apparatus which consisted of at least one pair of side-by-side ducts positioned across the path of travel of the material being treated. Each duct was provided with a continuous, longitudinally extending air nozzle which projected outwardly from the duct towards the material being treated. The nozzles were spaced from the material so that the gaseous medium flowing from one nozzle converged and merged with the gaseous medium flowing from the other nozzle forming a common stream at least at the path of travel of the material. One of the ducts was fed by treating medium from one side of the material being treated and the other duct was fed by treating medium from the opposite side of the material being treated. Thus the main directions of flow of the treating medium in the two ducts were opposite one another with the result that the flows from the nozzles had opposite longitudinal velocity components in addition to vertical velocity components. The longitudinal velocity components of the two streams tended to cancel each other, and the high velocity vertical components of one stream reinforced the low velocity vertical components of the other at any given location along the nozzle, and vice versa such that the common stream produced by the combined flows was uniform along its length and essentially vertical in direction. This also resulted in a swirling motion in the common stream which impinged against the material being treated increasing the efficiency of treatment. Because the nozzle openings were continuous and unbroken, this insured an even, unbroken stream of fluent medium against the material being treated.

Whereas the invention of prior U.S. Pat. No. 3,429,057 constituted a substantial advance in the art, particularly for the plastic film industry where cross-web uniformity of treating medium is critical, it was found that the protruding nozzle lips of the nozzle arrangement were vulnerable to entanglement with film if or when a break in the web occurred. It is a simple matter to simply eliminate the protruding nozzle lips and employ a sharp-edged orifice, but it was found that such a modification or change would create a very high static pressure drop in the nozzle. Since the fan horsepower for recirculation heat treating apparatus is directly proportional to static pressure, the very high static drop created a fan horsepower consumption which was far in excess of that desired for commercial recirculation heat treating apparatus.

SUMMARY OF THE INVENTION

These and other disadvantages are overcome in accordance with the concepts of the present invention by employing; in an apparatus for treating with a fluent medium materials conveyed therethrough in a conveying plane, wherein said apparatus comprises (a) at least one pair of elongated ducts extending transverse to the direction of conveyance in said plane and positioned adjacent to one another; (b) means at opposite ends of said ducts to supply a fluent medium to said ducts whereby the main direction of flow in one duct is opposite that in the other duct; (c) an elongated nozzle in each of said ducts adjacent the nozzle in the other duct extending across said plane and adapted to project an elongated common stream of fluent medium outwardly impinging against the material in said conveying plane, along a line; the improvement comprising forming each of said nozzles of a pair of longitudinally extending converging surfaces positioned within the respective duct defining an elongated unobstructed narrowing passageway terminating in a continuous elongated nozzle opening substantially flush with the outer surface of the duct.

In a preferred embodiment one of said surfaces is defined by a single flat plate common to both nozzles of said pair of ducts, the opposite surface being defined by a lip of each duct formed into a half-round configuration protruding inwardly of the duct.

As with the invention of prior U. S. Pat. No. 3,429,057, the flows from the duct nozzles will have both longitudinal and vertical velocity components. The longitudinal velocity components will cancel each other, and low velocity vertical components from one duct will be reinforced by high velocity vertical components from the other duct and vice versa. The result will be a common stream emerging from the two ducts which is substantially perpendicular to the material being treated, which has a generally swirling motion increasing the efficiency of heat transfer, and which is uniform across the width of said material. At the same time, the present invention eliminates the problem of entanglement with a broken web or the like. This is accomplished without significant increase in horsepower consumption.

The present invention is particularly important for the plastic film industry.

BRIEF DESCRIPTION OF THE DRAWINGS

The invention and advantages thereof will become more apparent upon consideration of the following specification and claims taken in conjunction with the accompanying drawings, in which;

Figure 1:
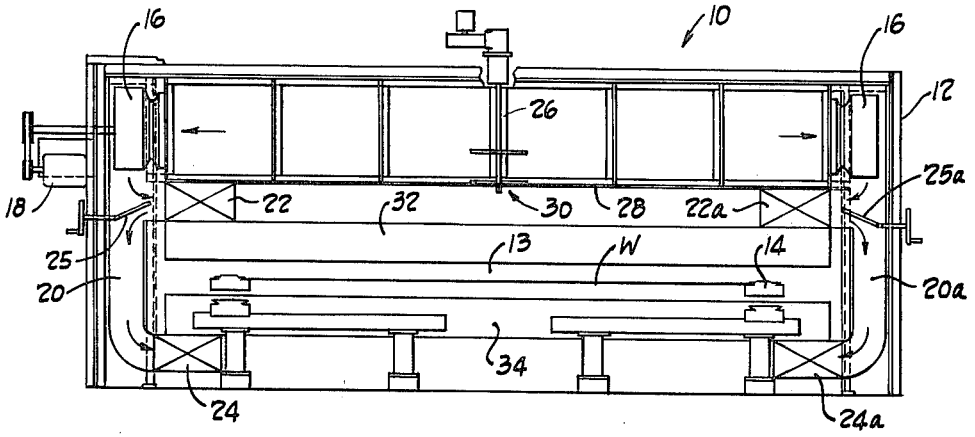
FIG. 1 is a cross-section, elevation view of a gas treating apparatus utilizing a novel nozzle arrangement in accordance with the concepts of the present invention.

Referring now to the drawings, dryer 10 comprises a generally rectangular housing 12 provided with heat treating chamber 13 through which web material W is conveyed, in the present instance, by a tenter-type conveyor 14. For purposes of the following description, it should be recognized that the web W includes sheet material, fabric, a batt of loose fibers, and granular material, although in a preferred embodiment, the present invention is concerned with the drying of plastic film. In operation, the web W enters an inlet end of the housing 12, moving longitudinally within the housing chamber 13, and egresses at an outlet end. Air locks, not shown, are provided at opposite ends of the housing.

Figure 2:
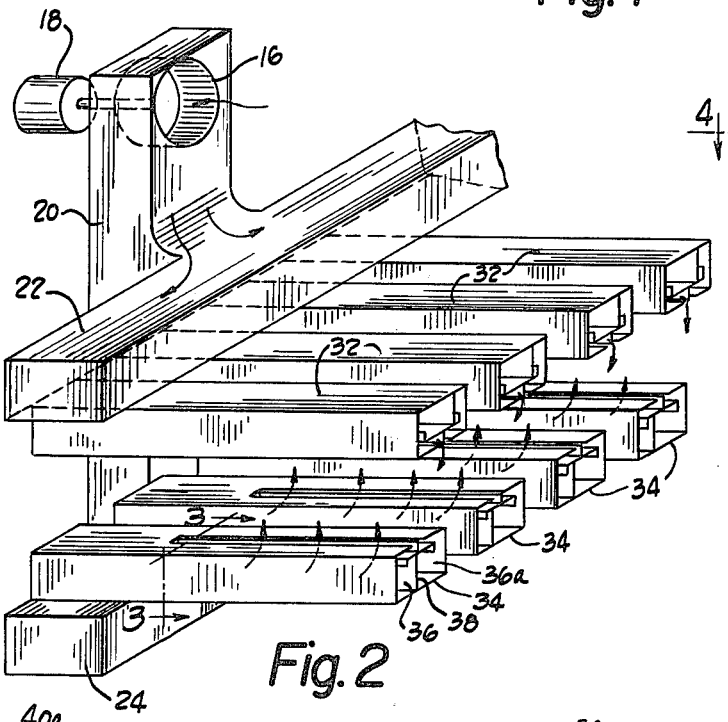
FIG. 2 is an enlarged, perspective view illustrating the gas duct arrangement of the apparatus of FIG. 1.

In the apparatus of the present invention, air or other suitable gaseous drying medium is circulated through the housing 12 by means of a plurality of fans or blowers 16, driven in the present instance by separate motors 18 located externally of the housing 12. This is best illustrated in FIGS. 1 and 2. The blowers 16 discharge into downwardly extending ducts 20 and 20*a* located on opposite sides of the housing 12. A first pair of longitudinally extending plenum chambers 22 and 22*a* are provided above the plane of travel of the web W, also on opposite sides of the housing 12. A second pair of longitudinally extending plenum chambers 24 and 24*a* are provided below the plane of travel of the web W, also on opposite sides of the housing 12. The left-hand, downwardly extending duct 20 is in fluid communication with the plenum chamber 22 and 24; and the right-hand duct 20*a* is in fluid communication with plenum chambers 22*a* and 24*a*. Flow divider 25 in duct 20 distributes the air evenly into plenum chambers 22 and 24, and flow divider 25*a* in duct 20*a* distributes the air evenly into plenum chambers 22*a* and 24*a*.

Above the plane of travel of the web W, heater 26 is provided, intermediate the fans 16, to impart heat to the drying medium in order to more efficiently dry the web W as it passes through dryer 10. This is accomplished by means of duct 28, above the web W, which houses, in part, the heater 26. The duct 28 is provided with opening 30 in communication with treating chamber 13 of the dryer to collect the treating medium or air which is the chamber, and to recirculate the same to the suction side of blowers 16.

For distribution of the treating medium or air from the plenum chambers to the treating chamber 13 and plane of travel of the web W, there is provided a plurality of pairs of upper and lower blow or pressure boxes 32 and 34, arranged above and below the plane of travel of the web W and positioned transversely thereto. As will be shown, the blow boxes are in fluid communication with the plenum chambers 22 and 24.

Figure 3:
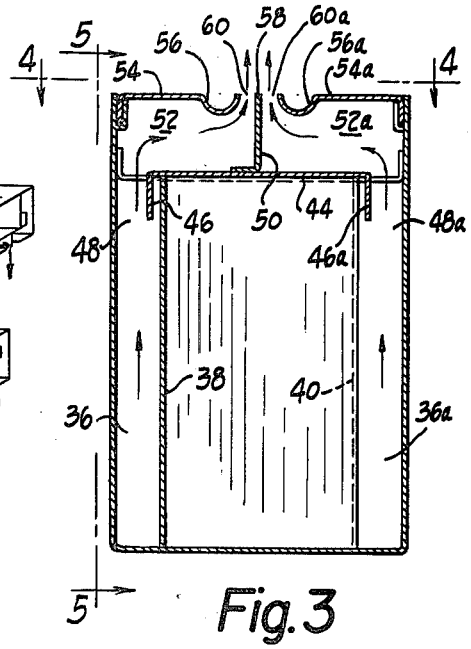
FIG. 3 is a further enlarged, section view taken in plane 3—3 of FIG. 2.
Figure 4:
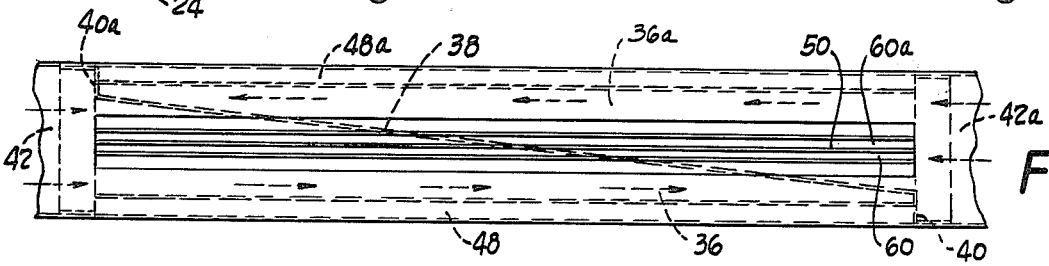
FIG. 4 is a top view of the blow box of FIG. 3 taken along line 4—4 of FIG. 3.
Figure 5:
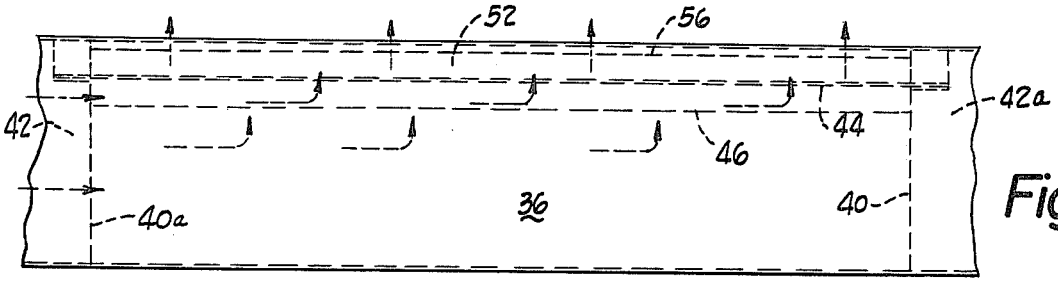
FIG. 5 is a side elevation view of the blow box of FIG. 3 taken along line 5—5 of FIG. 3.

Details of the blow boxes are shown in FIGS. 3, 4 and 5. Each blow box comprises a pair of ducts 36 and 36*a* which extend longitudinally within the blow box, in a side-by-side relationship. This is accomplished by divider 38 shown in dashed lines in FIG. 4. The dividers are oriented vertically within the blow boxes, and extend somewhat diagonally and longitudinally within the boxes. At opposite ends of each blow box, plates 40 and 40*a* are provided connected between the divider 38 and blow box adjacent sides. The plate 40, shown in FIG. 4, closes off the right-hand end of duct 36, and the plate 40*a* closes off the left-hand end of duct 36*a*. Thus, duct 36 is open, at its left end, at inlet 42; and duct 36*a* is open, at its right end, at inlet 42*a*.

With reference to the particular blow box illustrated in FIGS. 3 and 4, the entrance end 42 of duct 36 is in fluid communication with left-hand plenum chamber 24, and the inlet end 42*a* of duct 36*a* is in fluid communication with right-hand plenum chamber 24*a*. Thus air enters the duct 36 from the left side of the housing 12, flowing to the right; and duct 36*a* from the right side of the housing, flowing to the left, as indicated by the arrows in FIG. 4.

In the embodiment of FIG. 2, four blow boxes are shown above the plane of web W, and four below, each comprising two side-by-side ducts with oppositely flowing air streams. In actual practice, a plenum chamber group, such as chambers 22, 24, 22*a*, and 24*a*, will be connected to seven or eight, or even more, blow box pairs. The dryer in turn will contain multiple assemblies, along its length, composed of the plenum chamber groups, air recirculation means, and distribution ducts.

Referring back to FIG. 3, a horizontal partition 44 is provided in the blow boxes, spaced from the bottom of the duct but parallel therewith. This horizontal partition rests against the upper edge of the vertically oriented partition 38, and has longitudinal edges 46 and 46*a* spaced from the sides of the blow boxes to define longitudinally extending slots 48 and 48*a*. Above the horizontal partition 44, a vertical partition 50 divides the blow box into two upper chambers 52 and 52*a* which are in communication with the lower ducts 36 and 36*a*, respectively, through the slots 48 and 48*a*.

The top of the blow box (FIG. 3) is formed of two longitudinally extending plates 54 and 54*a* which are fastened along their outer longitudinal edges to the upper edges of the blow box side walls. The inner longitudinal edges of the plates are formed into the shape of half-round lips 56 and 56a which extend into the chambers 52 and 52a. The dimensions of the half-rounds are such that they are equally spaced from the free edge 58 of the vertical partition 50 between chambers 52 and 52a. This thus provides adjacent longitudinally extending continuous, unobstructed, gradual narrowing passageways 60 and 60a terminating in a pair of adjacent nozzle openings of constant width, substantially flush with the outer upper surface of the blow box.

By virtue of the half-round shape of the lips 56 and 56a of the plates 54 and 54a, the passageways 60 and 60a are formed of converging surfaces (converging on common member 50) which they virtually eliminates static pressure drop in the nozzle passageways, reducing horsepower consumption in blowers 16.

The location of partitions 38 within the blow boxes, as shown in FIG. 4, such that they extend somewhat diagonally longitudinally within the blow boxes, causes the oppositely moving air streams in ducts 36 and 36a to flow progressively into areas of smaller cross-section. This compensates for air flow emitted from each duct and achieves a more uniform flow velocity longitudinally in the nozzle passageways 60 and 60a.

The advantage of the half-round nozzle lip configurations protruding into the upper chambers is that this construction eliminates nozzle protruding parts which would or could be vulnerable to entanglement with film or web if a break in the film or web should occur in the dryer.

Instead of a half-round configuration, other configurations are possible, such as a V-shaped configuration. The critical feature is to provide a passageway of gradually diminishing cross-section to achieve a reduction in static pressure drop. The half-round configuration is easy to form and has an inherent degree of strength.

The following comparative data of Table 1 is illustrative of advantages, or the more than expected reduction in static pressure drop, achieved by the concepts of the present invention. Static pressures in inches water column were measured mid-point in lower chambers 36 and 36a, and in upper chambers 52 and 52a for a nozzle outlet velocity of 1053 feet per minute employing; on the one hand, a pair of sharp-edged orifices (that is, defined by free, unshaped flat edges of plates 54 and 54a, and free edge 58 of partition 50); and on the other hand, the orifices of FIG. 3. Nozzle dimensions in both instances were 220 inches by one-half inch.

Table 1

| Location | Static Pressure with Sharp-edged Orifice | Static Pressure with Shaped Orifice |
|---|---|---|
| Chamber 36 | 1.46" | .101" |
| Chamber 36a | 1.43" | .092" |
| Chamber 52 | 1.22" | .067" |
| Chamber 52a | 1.17" | .056" |

It is apparent that the present invention achieves on the order of 1 to 15 reduction in static pressure.

The following Table 2 gives comparative fan horsepower (calculated) required per nozzle, for varying nozzle exit velocities and flows in cubic feet per minute, for the two nozzle configurations.

Table 2

| Nozzle Velocity FPM | Nozzle Flows CFM | Horsepower Sharp-edged Orifice | Horsepower Shaped Orifice |
|---|---|---|---|
| 2000 | 1528 | .25 | .10 |
| 3000 | 2292 | 1.7 | .45 |
| 4000 | 3056 | 2.7 | 1.3 |
| 5000 | 3820 | 5.2 | 3.3 |

It is evident from the data of Table 2 that a dramatic decrease in horsepower required is achieved by the concepts of the present invention.

The present invention is particularly important where the flow into the nozzles takes a tortuous path from the lower chambers 36 and 36a through slots 48 and 48a into upper chambers 52 and 52a. In this construction, the air flow, with regard to the generally vertical component of flow, takes nearly a righthand bend to exit in the nozzle passageways 60 and 60a. Such a construction would tend to compound any static pressure drop existing in the nozzle passageways, making a low pressure drop in the nozzle passageways of critical importance. The purpose of the use of sequential upper and lower chambers, separated by slots 48 and 48a, is to even out or smooth variations in flow longitudinally across the width of the dryer.

Prior U.S. Pat. No. 3,429,057 illustrates an embodiment in which the main plenum chamber in communication with the blow or pressure boxes extends along one side of the dryer only. In this embodiment, means are provided at the exhaust end of one of the ducts of the blow box to reverse the direction of flow of the air stream so that it enters the cooperating duct at the opposite feed end to flow back in this duct. The same improvement can be employed in the present invention employing an arcuate deflector to redirect the gaseous flow into the inlet end of the cooperating duct. The same tapering arrangement (forming the ducts 36 and 36a of progressively smaller cross-sectional area) would be employed to insure uniformity of the velocity of air flow from the nozzle openings across the web along the line of impingement of the blow box common drying streams against the web.

Prior U.S. Pat. No. 3,429,057 also described an arrangement by which a variable damper is employed at the duct inlets to adjust the medium flow into one duct relative that into the adjacent duct. The same arrangement can be employed in the present invention. Also, means may be provided for variably positioning common divider 50 towards one of the nozzle lips or the other. This permits increasing or decreasing the size of one nozzle opening relative the other permitting a greater or lesser velocity of air to emit from ome or the other of the nozzles. This feature can also be used to vary the velocity and/or the angle of the stream of gaseous medium as it leaves or is emitted from the nozzles associated with the ducts.

Advantages of the present invention should be apparent. In particular, the drying medium from the side-by-side nozzles, upon merging, will cause a common stream of medium flow to impinge against the web along a line transverse to its direction of movement, in a direction perpendicular to the plane of the web W. The perpendicular flow is particularly good for achieving uniformity of drying and maximum efficiency.

In addition to promoting the substantially perpendicular medium flow, impinging upon opposite sides of the web, it has been discovered that by providing the nozzles with gaseous medium inlets at opposite ends to provide a stream of medium emitting fron one nozzle having a longitudinal current opposite to the longitudinal current of the gaseous medium stream flowing from the other nozzle, a slight criss-cross medium occurs causing turbulence in the merged gaseous medium stream. In this manner, a gentle agitation is effected at the point of impingement on the web causing a slightly turbulent action of the air against the material on which the web is composed thus promoting a highly efficient and rapid drying of the web material, especially important when the web material is a fibrous material.

In certain instances where it is desirable to promote the mass movement of medium in order to effect drying very quickly, and where the material being dried is not capable of being subjected to high temperature medium, the ducts 36 and 36*a* may be spaced laterally apart one from the other so as to permit the venturi effect caused by the medium emitted from the converging nozzles to create an updraft, or downdraft as the case may be, promoting medium flow between the adjacent ducts. In this case, each nozzle passageway can be formed by a pair of half-round lips, or other configuration, to form the desired converging surfaces.

What is claimed is:

1. Apparatus for treating with gaseous medium materials conveyed therethrough in a conveying plane, comprising:

at least one pair of elongated ducts extending transverse to the direction of conveyance in said plane and positioned adjacent to one another;

means at opposite ends of said ducts to supply fluent medium to said ducts whereby the main direction of flow in one duct is opposite that in the other duct;

an elongated nozzle in each of said ducts adjacent the nozzle in the other duct extending across said plane and adapted to project an elongated common stream of fluent medium outwardly impinging against the material in said conveying plane along a line;

each of said nozzles comprising a pair of longitudinally extending converging surfaces positioned within the respective duct defining an elongated unobstructed narrowing passageway terminating in a continuous elongated nozzle opening substantially flush with the outer surface of the duct;

the elongated stream of gaseous medium flowing from one nozzle having a longitudinal current opposite to the longitudinal current of the gaseous medium stream flowing from the other nozzle thereby creating a swirling motion in said common stream along said line.

2. The apparatus of claim 1 wherein one of said converging surfaces is defined by a single flat plate common to both elongated nozzles of said pair of ducts, the opposite converging surface being defined by a lip of the duct formed into a half-round configuration.

* * * * *

UNITED STATES PATENT AND TRADEMARK OFFICE

CERTIFICATE OF CORRECTION

PATENT NO. : 4,170,075

DATED : October 9, 1979

INVENTOR(S) : John F. Scott

It is certified that error appears in the above-identified patent and that said Letters Patent are hereby corrected as shown below:

Column 1, line 6, change "materals" to --materials--. Column 2, line 39, after "static", insert --pressure--. Column 4, line 13, before "the chamber", insert --in--. Column 5, line 16, change "they" to --thereby--; line 64, before "1 to 15", insert --a--. Column 6, line 54, after "emit from", change "ome" to --one--. Column 7, line 3, after "emitting", change "fron" to --from--.

Signed and Sealed this

*Fifteenth* Day of *January 1980*

[SEAL]

*Attest:*

SIDNEY A. DIAMOND

*Attesting Officer*

*Commissioner of Patents and Trademarks*